US006282883B1

(12) United States Patent
Uematsu et al.

(10) Patent No.: US 6,282,883 B1
(45) Date of Patent: Sep. 4, 2001

(54) HYDROGEN BURNING TURBINE PLANT

(75) Inventors: Kazuo Uematsu; Takashi Sonoda, both of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/145,018

(22) Filed: Sep. 1, 1998

(30) Foreign Application Priority Data

| | | |
|---|---|---|
| Sep. 5, 1997 | (JP) | 9-241190 |
| Sep. 5, 1997 | (JP) | 9-241191 |
| Sep. 5, 1997 | (JP) | 9-241192 |
| Sep. 17, 1997 | (JP) | 9-252099 |

(51) Int. Cl.[7] ..... F02C 3/22; F02C 6/18

(52) U.S. Cl. ..... 60/39.182; 60/39.465; 60/39.52

(58) Field of Search ..... 60/39.182, 39.52, 60/39.53, 39.465

(56) References Cited

U.S. PATENT DOCUMENTS

| | | | | |
|---|---|---|---|---|
| 5,644,911 | * | 7/1997 | Huber | 60/39.52 |
| 5,687,559 | | 11/1997 | Sato . | |
| 5,782,081 | * | 7/1998 | Pak | 60/39.52 |
| 5,809,768 | | 9/1998 | Uematsu et al. . | |

FOREIGN PATENT DOCUMENTS

| | | |
|---|---|---|
| 6-299805 | 10/1994 | (JP) . |
| 08/226335 | 9/1996 | (JP) . |
| 09/144559 | 6/1997 | (JP) . |
| 09151750A | 6/1997 | (JP) . |

OTHER PUBLICATIONS

Von H. Jericha et al., Weiterentwicklund des $H_2/O_2$–Dampfprozesses (Brennkammer und Hochtemperaturturbine), Sep. 1, 1993, pp. 781–786.

* cited by examiner

*Primary Examiner*—Louis J. Casaregola
(74) *Attorney, Agent, or Firm*—Wenderoth, Lind & Ponack, L.L.P.

(57) ABSTRACT

Easy plant starting is provided in a hydrogen burning turbine plant for burning hydrogen and oxygen to generate high temperature steam for driving a turbine. There is constructed a semi-closed cycle such that low temperature steam from compressor 1 enters combustion chamber 2, hydrogen and oxygen are burned in the combustion chamber 2 to become high temperature steam for driving turbine 3, and the steam provides exhaust heat at heat exchanger 4 and then returns to low pressure compressor 1-1. Steam from midway of the heat exchanger 4 enters low pressure turbine 6 for work therein, and is condensed to water. The water from condenser 7 is heated at heat exchangers 4-4, 4-3, 4-2 to become steam for driving high pressure turbine 5, and returns to the combustion chamber 2 through the heat exchanger 4. An a auxiliary boiler is provided at inlet side of the compressor 1, and the high temperature steam generated at the combustion chamber 2 at the starting time is diluted and supplied into the turbine 3. Thus, the starting can be performed smoothly.

19 Claims, 7 Drawing Sheets

HYDROGEN BURNING TURBINE PLANT

BACKGROUND OF THE INVENTION

1. Field of the Invention

The present invention relates to a hydrogen burning turbine plant for burning hydrogen and oxygen to generate steam for thereby driving a turbine, and specifically to such a turbine plant in which a turbine operation at a starting time of the plant is facilitated, and a steam utilizing efficiency is enhanced.

2. Description of the Prior Art

A concept of a hydrogen burning turbine plant in which hydrogen and oxygen are burned in a combustion apparatus to generate steam of about 3,000° C. for thereby driving a turbine is presently being studied, and systems thereof having various features are known now. But in the practical use thereof, there are various problems such that it is the present situation that an ensured technology has not yet been obtained. Examples of such a hydrogen burning turbine plant will be shown in FIGS. 5 and 6 with outlined description as herebelow.

In a system of FIG. 5, which is disclosed in the Japanese laid-open patent No. Hei 6(1994)-299805, a cycle of steam is constructed such that a low temperature steam from a compressor 52 becomes a high temperature steam at a hydrogen oxygen combustor 50, and enters a turbine 53 for driving it so that power is generated at a generator 54. Then the steam which has become a low temperature steam flows in a heat exchanger 55 and returns to the compressor 52. The low temperature steam which has come out of the turbine 53 drives a condensing turbine 63 for thereby driving a generator 64 for power generation, and is then condensed to water at a condenser 65. Also, another cycle of steam is constructed such that water fed by a pump 62 is heated at the heat exchanger 55 to become steam, and then enters an expansion turbine 56 for thereby driving a generator 57 for power generation. Then the steam which has become a low temperature steam is heated to a high temperature at a hydrogen oxygen combustor 58, enters a condensing turbine 59 for thereby driving a generator 60 for power generation, is then condensed to water at the condenser 61, and then flows to the heat exchanger 55 again via the pump 62. In the present system, exhaust heat is recovered downstream of the turbines, and two units of the hydrogen oxygen combustors are provided, to thereby aim at a higher efficiency.

FIG. 6 shows another example of system using a hydrogen oxygen combustor. In the figure, a cycle of steam is constructed such that steam fed through a low pressure compressor 100, an intercooler 101 and a high pressure compressor 102 enters a hydrogen oxygen combustor 104 through a first heat exchanger 103 at which the steam is heated to a high temperature to drive a first turbine 105 for thereby driving a generator 114 for power generation. The steam then flows in the first heat exchanger 103 and a second heat exchanger 106 for producing exhaust heat, and after flowing through a third heat exchanger 107, a potion of the steam drives a second turbine 109 for thereby driving a generator 115 for power generation, and another portion of the steam flows through a fourth heat exchanger 108 to enter the low pressure compressor 100 again.

The steam which has become a low pressure steam after flowing in the second turbine 109 is condensed to water at a condenser 111, is heated at a first feedwater heater 117 and a second feedwater heater 118, flows in the fourth and third heat exchangers 108, 107, respectively, via a pump 112, to be heated by the exhaust heat. The water is then further heated to a high temperature at the second heat exchanger 106 and drives a third turbine 110 for thereby driving a generator 116 for power generation. Then, the steam which has become a low temperature steam is partially used for cooling of the first turbine 105, and remaining steam is returned to an outlet side of the high pressure compressor 102 to flow into the first heat exchanger 103.

Numeral 119 designates the cooling steam for the first turbine 105. In the present system, in order to attain a high efficiency of the compressors without making the pressure ratio higher, the system is so constructed that the heat exchangers are provided between the upstream side of the hydrogen oxygen combustor 104 and the downstream side of the first turbine 105. Thus, the exhaust heat is made use of efficiency.

As mentioned in the prior art examples of FIGS. 5 and 6, with respect to the system having the combustion apparatus for burning hydrogen and oxygen to generate a high temperature steam for thereby driving a turbine, there are considered and studied systems having various features for making effective use of the high temperature heat generated for obtaining a high efficiency. In order to make practical use thereof however, because the steam generated by burning hydrogen and oxygen is of a high temperature of about 3,000° C., it becomes necessary to obtain some measure by which the high temperature steam at a sting time of the plant is diluted and reduced to a temperature such that it is able to be introduced into the turbine. Of all the various systems considered at the present time, there is no established system for appropriate staring and running of such systems.

Also, unless the control system is appropriate for starting the operation and continuing the operation until the steam condition of pressure and temperature is established at each portion of the cycle, wet steam can enter into the compressor or turbine, whereby there arises a risk of breakage of the compressor or turbine. It is necessary, therefore, to obtain an established system for watching conditions at each portion of the plant and appropriately controlling flow of steam there. In the present sate hydrogen burning turbine plant, although systems having various features are disclosed, there is not yet established a sufficient control system for effecting operation of an actual plant.

Further, in a prior art hydrogen burning turbine plant shown in FIG. 7, while a portion of exhaust gas (steam) coming out of a third turbine 110 is used as a cooling steam for turbine blades etc. of a first turbine 105, in order to obtain a higher efficiency of this turbine plant, it becomes necessary to reduce the cooling steam of the first turbine 105 as much as possible or to employ a cooling system having a small reduction in gross thermal efficiency.

SUMMARY OF THE INVENTION

It is therefore an object of the present invention to provide a hydrogen burning turbine plant for burning hydrogen and oxygen to genearate a high temperature steam for driving a turbine. The plant comprises a start system such that high temperature steam generated at a combustion chamber is diluted at a staring time, and maintain as such, until a self-sustaining operation using the steam generated at the combustion chamber can be started.

Also, in view of the fact that wet steam enters the compressor or turbine, which results in a risk of breakage thereof, unless the control system is appropriate at the starting time and until the condition of steam pressure and temperature is established at each portion of the cycle, it is necessary to obtain an established system for watching conditions at each portion of the plant and appropriately controlling flow of steam threat. Therefore, it is also an object of the present invention to provide a hydrogen burning turbine plant for burning hydrogen and oxygen to generate a high temperature steam for driving a turbine, with the plant having a function of control for detecting pressure and temperature of stem at each inlet potion of the turbine or compressor at a starting time, and for discharging the steam at each inlet portion via a drain valve until dryness of the steam to the extent allowable at each inlet portion is detected.

Furthermore, it is an object of the present invention to provide a controlling system for controlling steam flow rate in a compressor, or a high pressure turbine and low pressure turbine, and for controlling fuel flow rate in a combustion chamber, to thereby make a safe operation possible, and also to make effective use of a cooling system.

In order to attain these objects, the present invention provides the structure and arrangements mentioned in (1) to (18) below:

(1) A hydrogen burning turbine plant for burning hydrogen and oxygen to generate a high temperature steam for driving a turbine, characterized in being constructed to form a semi-closed cycle such that hydrogen and oxygen are burned in a combustion chamber for generating the high temperature steam. The high temperature steam is supplied into a turbine for drive thereof, an exhaust steam from the turbine is fed into a heat exchanger for producing an exhaust heat, the steam flowing out of the heat exchanger is fed into a compressor, and a compressed steam discharged from the compressor is returned into the combustion chamber.

(2) A hydrogen burning turbine plant as mentioned in (1) above, characterized in that the semi-closed cycle is provided with an auxiliary boiler. The high temperature steam generated at the combustion chamber is diluted for a predetermined time at a starting of the semi-closed cycle with steam generated at the auxiliary boiler.

(3) A hydrogen burning turbine plant as mentioned in (2) above, characterized in that the auxiliary boiler supplies a high pressure steam either into an outlet of the compressor or into a casing surrounding the combustion chamber.

(4) A hydrogen burning turbine plant as mentioned in (2) above, characterized in that the auxiliary boiler supplies a low pressure steam into an outlet of the compressor or, if the compressor is divided into a low pressure part and a high temperature part, either into an inlet of the compressor or midway between the low pressure part and the high pressure part.

(5) A hydrogen burning turbine plant for burning hydrogen and oxygen to generate a high temperature steam for diving a turbine, characterized in being constructed to form a semi-closed cycle such that hydrogen and oxygen are burned in a combustion chamber for generating the high temperature steam. The high temperature steam is supplied into a turbine for drive thereof, an exhaust steam from the turbine is fed into a heat exchanger for producing an exhaust heat, the steam flowing out of said heat exchanger is fed into a compressor, and a compressed steam discharged from the compressor is returned into the combustion chamber. The exhaust heat recovered at the heat exchanger is supplied to an inlet flow passage of a high pressure turbine provided separately from the semi-closed cycle. A portion of the steam flowing from the turbine into the heat exchanger is extracted from a flow passage leading to the compressor, and is supplied to a low pressure turbine provided separately from the semi-closed cycle. Return steam of the low pressure turbine is supplied to a condenser. Also provided in the plant are a steam pressure sensor, a steam temperature sensor, a drain valve and a control unit which effects a control at a starting of the plant. Detected signals from both sensors are inputted to the control unit and, based on such inputted signals, the drain valve is opened so that the steam is discharged therefrom until a dry steam condition of predetermined steam pressure and steam temperature is satisfied.

(6) A hydrogen burning turbine plant as mentioned in (5) above, characterized in that the steam pressure sensor, the steam temperature sensor and the drain valve are provided on an inlet side of the high pressure turbine provided separately from the semi-closed cycle.

(7) A hydrogen burning turbine plant as mentioned in (5) above, characterized in that the steam pressure sensor, the steam temperature sensor and drain valve are provided on an inlet side of the compressor.

(8) A hydrogen burning turbine plant as mentioned in (5) above, characterized in that the steam pressure sensor, the steam temperature sensor and the drain valve are provided on an inlet side of the low pressure turbine provided separately from the semi-closed cycle.

(9) A hydrogen burning turbine plant as mentioned in (5) above, characterized in that a portion of return steam from the high pressure turbine is extracted to be used as a blade cooling steam for the turbine, and the steam pressure sensor, the steam temperature sensor and the drain valve are provided in a system to effect such an extaction.

(10) A hydrogen burning turbine plant as mentioned in (5) above, characterized in that the steam pressure sensor, the steam temperature sensor and the drain valve are provided on the inlet side of the high pressure turbine, on the inlet side of the compressor, on the inlet side of the low pressure turbine and on an outlet side of the high pressure turbine, wherein the control unit controls all of the drain valves.

(11) A hydrogen burning turbine plant for burning hydrogen and oxygen to generate a high temperate steam for driving a turbine, characterized in being constructed to form a semi-closed cycle such that hydrogen and oxygen are burned in a combustion chamber for generating the high steam. The high temperature steam is supplied into a turbine for drive thereof, an exhaust steam from the turbine is fed into a heat exchanger for providing an exhaust heat, the steam flowing out of the heat exchanger is fed into a compressor and a compressed steam discharged from the compressor is returned into the combustion chamber. The exhaust heat recovered at the heat exchanger is supplied to an inlet flow passage of a high pressure turbine provided separately from the semi-closed cycle. A portion of the steam flowing from the turbine into the heat exchanger is extracted from a flow passage leading to the compressor, and is supplied to a low pressure turbine provided separately from the semi-closed cycle. Return steam of the low pressure turbine is supplied to a condenser. Also provided in the plant is a control unit which is able to control a steam flow rate based on a predetermined steam condition, and also control a fuel flow rate based on a predetermined fuel condition.

(12) A hydrogen burning turbine plant as mentioned in (11) above, characterized in that some stationary blades of the compressor are variable blades, and the control unit controls the variable blades to control steam flow rate and pressure at the compressor.

(13) A hydrogen burning turbine plant as mentioned in (11) above, characterized in that the control unit controls a valve provided on an inlet side of the high pressure turbine, controls rotation of a pump in a steam flow passage on the inlet side and controls an output of the high pressure turbine.

(14) A hydrogen burning turbine plant as mentioned in (11) above, characterized in that the control unit controls a valve provided on an inlet side of the low pressure turbine.

(15) A hydrogen burning turbine plant as mentioned in (11) above, characterized in that a portion of return steam from the high pressure turbine is extracted to be used as a blade cooling steam for the turbine, and the control unit controls a valve provided in a system to effect such an extraction.

(16) A hydrogen burning turbine plant as mentioned in (11) above, characterized in that the control unit detects a steam temperature of the turbine, and controls a hydrogen and oxygen supply valve of the combustion chamber so as not to exceed a predetermined turbine inlet temperature

(17) A hydrogen burning turbine plant as mentioned in (11) above, characterized in that the control unit watches and controls some or all of the variable blades of the compressor, an inlet valve of the high pressure turbine, an inlet valve of the low pressure turbine, an inlet valve of the blade cooling steam system of the turbine and a hydrogen and oxygen supply valve of the combustion chamber.

(18) A hydrogen burning turbine plant for burning hydrogen and oxygen to generate a high temperature steam for driving a turbine, characterized in being constructed to form a cycle such that hydrogen and oxygen are buried in a combustor for generating a high temperature steam. The high temperature steam is supplied into a first turbine for drive thereof, an exhaust steam from the first turbine is fed into a heat exchanger for providing an exhaust heat, the steam flowing out of the heat exchanger is fed into a compressor and a compressed steam discharged from the compressor is returned into the combustor. The exhaust heat recovered at the heat exchanger is supplied to an inlet flow passage of a third turbine provided separately from the cycle. A portion of the steam flowing from the first turbine into the heat exchanger is extracted from a flow passage leading to the compressor, and is supplied to a second turbine provided separately from the cycle. Return steam of the second turbine is returned to a condenser. Also provided in the plant is a recovery type cooling system in which steam extracted from an outlet of the third turbine is supplied into the first turbine as a recovery type cooling steam for cooling turbine blades, and the steam used for the cooling, after it has been temperature-elevated, is recovered into an inlet of the combustor.

According to the present invention constructed and arranged as mentioned above, the function and effect as mentioned below are obtained.

In the invention of (1) above, a semi-closed cycle is constructed by the passages connecting the compressor, combustion chamber, turbine and heat exchanger. Accordingly, thermal energy of the high temperature steam of the plant in which hydrogen and oxygen are burned to generate the high temperature steam for driving the turbine can be used effectively, and application of the system with enhanced efficiency can be easily preformed.

In the invention of (2) above, at a starting time of the semi-closed cycle of (1) above, the auxiliary boiler is operated, and the steam generated thereby is introduced into the combustion chamber to thereby dilute the high temperature steam of about 3,000° C. generated in the combustion chamber. The auxiliary boiler is continuously operated until the steam generated at the combustion chamber can be supplied so that the semi-closed cycle may become self-sustained. Thus the hydrogen burning turbine plant can start and continue smoothly until a steady operation is attained.

In the invention of (3) above, the auxiliary boiler of (2) above is one such as to generate a high pressure steam of 5 to 100 kg/cm$^2$a, and this auxiliary boiler can be connected to the outlet of the compressor or to the casing surrounding the combustion chamber. Thus, a burden at starting time of the compressor can be mitigated.

In the invention of (4) above, the auxiliary boiler of (2) above is one such as to generate steam of nearly atmospheric pressure of 0.5 to 5 kg/cm$^2$a, and this auxiliary boiler is connected for operation to the inlet of the compressor or, if the compressor is divided into a low pressure part and a high pressure part, either to the inlet of the compressor or midway between the low pressure part and the high pressure part thus, the auxiliary boiler can be made smaller and the facilities of the plant can be simplified.

Generally in the hydrogen burning turbine plant, hydrogen and oxygen are burned and a high temperature steam of about 3,000° C. is generated. It is necessary therefore, to dilute this high temperature steam using steam of the auxiliary boiler, so that the high temperature of the steam is reduced to an allowable temperature for the turbine. Thus, at a starting time and until the cycle may operate independently with the steam condition (pressure, temperature) being established, risk of breakage due to wet steam flowing into the turbine or compressor must be avoided. In the invention of (5) above, there are provided the steam pressure sensor and the steam temperature sensor in the steam flow passage, and the detected signals at both sensors is inputted into the control unit. In the control unit, a control operation is performed. A steam condition (pressure, temperature) of necessary dryness for the steady operation of the plant set in advance, is compared with the detected signs from both sensors at a staring time for judgment of whether or not the necessary steam condition for the steady operation is satisfied. If the steam condition is not satisfied, the drain valve is opened so that the steam is discharged therefrom. If the detected signals both satisfy the steam condition, the drain valve is closed and the cycle operates independently to move into the steady operation. Thus, the steam is discharged via the drain valve until the steam becomes dry to the extent to satisfy the condition (pressure, temperature) of the steam flowing into each relevant portion at the starting time of the plant. Thus, wet steam is prevented from flowing into the turbine or compressor at the starting time, and accordingly, risk of breakage thereof can be avoided and a safe starting becomes possible.

Also, the steam pressure sensor, the steam temperature sensor and the drain valve may be provided in the flow passage on the inlet side of the high pressure turbine provided separately from the semi-closed cycle, on the inlet side of the compressor and on the inlet side of the low pressure turbine provided separately from the semi-closed cycle as meted in the inventive aspects of (6), (7) and (8) above, respectively. Accordingly, the steam flowing into these devices may be controlled individually according to characteristics of respective plants.

Also, as in the invention of (10) above, the steam pressure sensor, the steam temperature sensor and the drain valve may be provided on the inlet and outlet sides of the high pressure turbine, on the inlet side of the compressor and on the inlet side of the low pressure turbine, respectively, and the control unit simultaneously watches and controls each of these devices. Thus, the control may be performed corresponding to a capability of each device of the plant, or to characteristics of the system.

Further, in the invention of (9) above, exhaust steam of the high pressure turbine provided separately from the semi-closed cycle is extracted partially to be used for cooling turbine blades, or to be used as a sealing steam. On the inlet side of such blade cooling steam also, there are provided the steam pressure sensor, the steam temperature sensor and the drain valve, so that the drain valve is controlled by the control unit at a starting time and steam is discharged via the drain valve until the steam condition is met. Thus, safety at the staring time of the plant is further strengthened.

In the hydrogen burning turbine plant, hydrogen and oxygen are burned, and steam generated thereby has a temperature of about 3,000° C. This high temperature steam is used for driving a turbine, and hence construction of the plant becomes complicated such that the steam of about 3,000° C. is diluted to a lower temperature, which is allowable for the turbine at the starting time. The steam is then supplied into the turbine, or there are provided facilities for making effective use of the high temperature steam so generated for a higher efficiency. Accordingly, control of the steam flow passages in such a complicated plant is important, and a control system which enables safe operation has been designed. Thus, according to the invention of (11) above, there is added the control unit effecting a control such that the condition of steam flow rate etc. at each relevant device is set in the control unit in advance. Thus, the stem flow rate at each relevant device is controlled based on the set steam condition, and the condition of fuel flow rate is set likewise, so that the fuel flow rate also is controlled. Thus, safe operation is secured.

In the invention of (12) above, in order to control the steam pressure in the compressor, stationary blades of the compressor are made as variable blades, and each of the variable blades is constructed, for example, to rotate around one point centered on the blade chord. Characteristics of the rotational angle of each variable blade, and the steam pressure are stored in the control unit in advance, and the angle of each blade is controlled so as to satisfy the set condition. Also, in the invention of (13) above, the valve is provided on the inlet side of the high pressure turbine, Predetermined characteristics of the opening of the valve and the steam pressure are stored in the control unit, and the valve and rotation of the pump can be controlled by the control unit so as to satisfy the set steam condition. Further, as mentioned in the invention of (14) above, the valve is provided on the inlet side of the low pressure turbine, the opening of the valve is controlled by the control unit as mentioned above, and the steam pressure at the inlet of the low pressure turbine can be controlled.

In the invention of (15) above, a portion of return steam of the high pressure turbine is extracted to be used for cooling turbine blades, and the valve is provided in the steam flow passage of the extracted steam. Thus the opening of the valve is controlled by the control unit as in the inventions of (13) and (14) above. Also, in the invention of (16) above, the control unit detects and watches the steam temperature of the turbine, and controls the hydrogen and oxygen supply valve of the combustion chamber so as not to exceed the predetermined turbine inlet temperature. Thus the turbine can be operated safely.

Furthermore, as mentioned in the invention of (17) above, the control unit can watch and control the variable blades of the compressor, the inlet valve of the high pressure turbine, the inlet valve of the low pressure turbine, the inlet valve of the turbine blade cooling steam and the hydrogen and oxygen supply valve of the combustion chamber, either individually or in combinations of ones necessary for safe operation of the plant. Thus the steam flow rate and pressure in the plant can be controlled securely and safely.

In the hydrogen burning turbine plant mentioned in the invention of (18) above, the cooling steam is fed from the third turbine into the first turbine through the recovery type cooling system, and is recovered into the inlet of the combustor. Thus, the amount of the cooling steam flowing into the gas path of the first turbine is reduced by the amount of the recovery. In the present hydrogen burning turbine plant, therefore, the mixing amount of the cooling steam in the turbine gas path is reduced, the temperature reduction of the fluid in the gas path and the pressure loss caused by mixing of the cooling steam and the fluid in the gas path can be reduced, and the heat obtained by cooling the first turbine can be recovered in the combustion chamber so that the flow rate of the fuel may be reduced. Thus, the gross thermal efficiency is enhanced.

DESCRIPTION OF THE PREFERRED EMBODIMENTS

Figure 1:
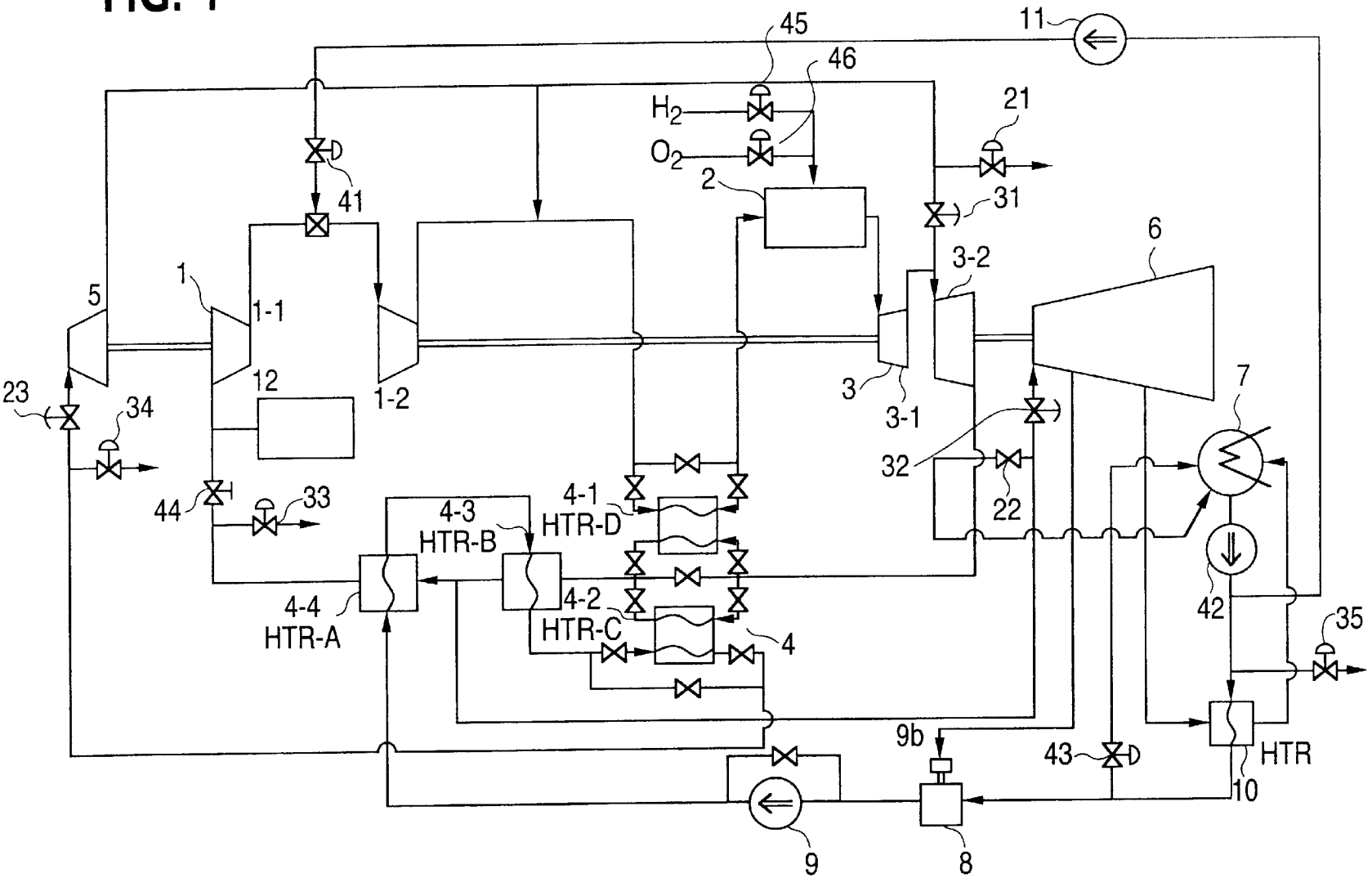
FIG. 1 is a diagrammatic view of a hydrogen burning turbine plant of one embodiment according to the present invention.

Herebelow, embodiments according to the present invention will be described with reference to the figures. FIG. 1 is a diagrammatic view of an entire hydrogen burning turbine plant of one embodiment according to the present invention. In FIG. 1, a compressor 1 consists of a low pressure compressor 1-1 and a high pressure compressor 1-2 coming out of the high pressure compressor 1-2 flows through a heat exchanger 4-1, enters a combustion chamber 2 in which oxygen and hydrogen, as fuel, are burned and the steam is heated to a temperature of about 3,000° C., and then flows into a turbine 3. The turbine 3 consists of a high temperature high pressure turbine 3-1 and a high temperature low pressure turbine 3-2. The high temperature high pressure turbine 3-1 is operated at about 1,700° C. as steam flowing thereinto is diluted by return steam. The high temperature low pressure turbine 3-2 is driven by exhaust steam of the high temperature high pressure turbine 3-1. Exhaust steam of the high temperature low pressure turbine 3-2 supplies heat to water at heat exchangers 4-3, 4-4, and then returns to the low pressure compressor 1-1. Thus, a cycle is constructed.

A portion of the steam coming out of the heat exchanger 4-3 drives a low pressure turbine 6 and, after having become a low temperature steam, flows through a heat exchanger 10 to give its heat to a water and then enters a condenser 7 to be condensed to water. The steam which has driven the low pressure turbine 6 and has been condensed to water flows into a deaerator 8 as it is.

A potion of the water from the condenser 7 is led into the heat exchanger 10 by a pump 42, is heated in the heat exchanger 10 and enters the deaerator 8 to be joined with water coming from the low pressure turbine 6. After being deaerated in the deaerator 8, the water flows through the heat exchangers 4-4, 4-3 via a feedwater pump 9 and activation of a valve, then flows through a heat exchanger 4-2 in which it is heated further, and then enters a high pressure turbine 5.

A portion of the steam used to drive the high pressure turbine 5 joins with steam at an outlet side of the high pressure compressor 1-2 to provide heat at the heat exchanger 4-1, and then returns to the combustion chamber 2. The remaining steam is sent to the high temperature low pressure turbine 3-2 to be used as a cooling steam thereof.

The water from the condenser 7 is conveyed by a pump 11 to an inlet side of the high pressure compressor 1-2, and is sprayed by an intercooler spraying valve 41 into the steam entering the high pressure compressor 1-2 so that the temperature of the steam thereat is adjusted.

There are provided a governor valve 23 and a drain valve 34 on the inlet side of the high pressure turbine 5, a governor valve 31 and a drain valve 21 on the inlet side of the high temperature low pressure turbine 3-2, a governor valve 32 and a drain valve 22 on the inlet side of the low pressure turbine 6, and a shut-off valve 44 and a drain valve 33 on the inlet side of the low pressure compressor 1-1. Accordingly, flow adjustment and drain discharge are effected, respectively.

In the construction of the hydrogen burning turbine plant as mentioned above, there is provided an auxiliary boiler 12 on the inlet side of the low pressure compressor 1-1, which auxiliary boiler 12 is used at a starting time of the plant. Hydrogen and oxygen, as fuel, are burned in the combustion chamber 2 and high temperature steam of about 3,000° C. is generated. This steam of about 3,000° C. is beyond an allowable temperature of steam to be introduced into the turbine 3-1, and hence it is necessary that this steam is diluted prior to being introduced into the turbine 3-1.

Thus, at the starting time, the auxiliary boiler 12 is operated so that a low temperature steam is fed to the inlet side of the low pressure compressor 1-1, which is to be supplied further to the combustion chamber 2 via the high pressure compressor 1-2 and the heat exchanger 4-1. Thus, the high temperature steam generated at the combustion chamber 2 is diluted to a temperature below 3,000° C., for example to about 1,700° C., which temperature is allowable for the steam to be introduced into the high temperature high pressure turbine 3-1. The steam is then supplied into the high temperature high pressure turbine 3-1 for operation.

That is, at the starting time, the auxiliary boiler 12 is operated, and then a system having a semi-closed cycle consisting of the compressor 1, the combustion chamber 2 and the heat exchanger 4-1 becomes operable by the steam generated at the combustion chamber 2. Once a steady operation state occurs, operation of the auxiliary boiler 12 is stopped, and the steady operation is continued by the steam generated at the combustion chamber 2.

It is to be noted that FIG. 1 shows an example where the auxiliary boiler 12 is positioned to be connected to the inlet side of the low pressure compressor 1-1 so as to supply steam hereto, and this example is appropriate for a case where the steam generated at the auxiliary boiler 12 has a pressure near the atmospheric pressure range of 0.5 to 5 $kg/cm^2a$. The auxiliary boiler 12 having the capacity to generate steam within such a pressure range may be connected midway of the low pressure compressor 1-1 and the high pressure compressor 1-2.

If the auxiliary boiler 12 has a capacity of getting steam within a high pressure range of 5 to 100 $kg/cm^2a$, there is no need to further pressurize the steam, the auxiliary boiler 12 may be connected to an outlet of the high pressure compressor 1-2 or to a casing surrounding the combustion chamber 2.

According to the hydrogen burning turbine plant of the embodiment described above, in the system for burning hydrogen and oxygen to generate a high temperature steam for driving a turbine, a semi-closed cycle consisting of passages of the compressor 1, the combustion chamber 2, the turbine 3-1 and the heat exchanger 4-1 is provided. The auxiliary boiler 12 is operated at a starting time of the plant so that high temperature steam of the auxiliary boiler 12 is diluted for start of the operation, and hence the start of the operation can be done smoothly. Accordingly, a start system of the hydrogen burning turbine plant has been established, and practical use of the system is possible.

Figure 2:
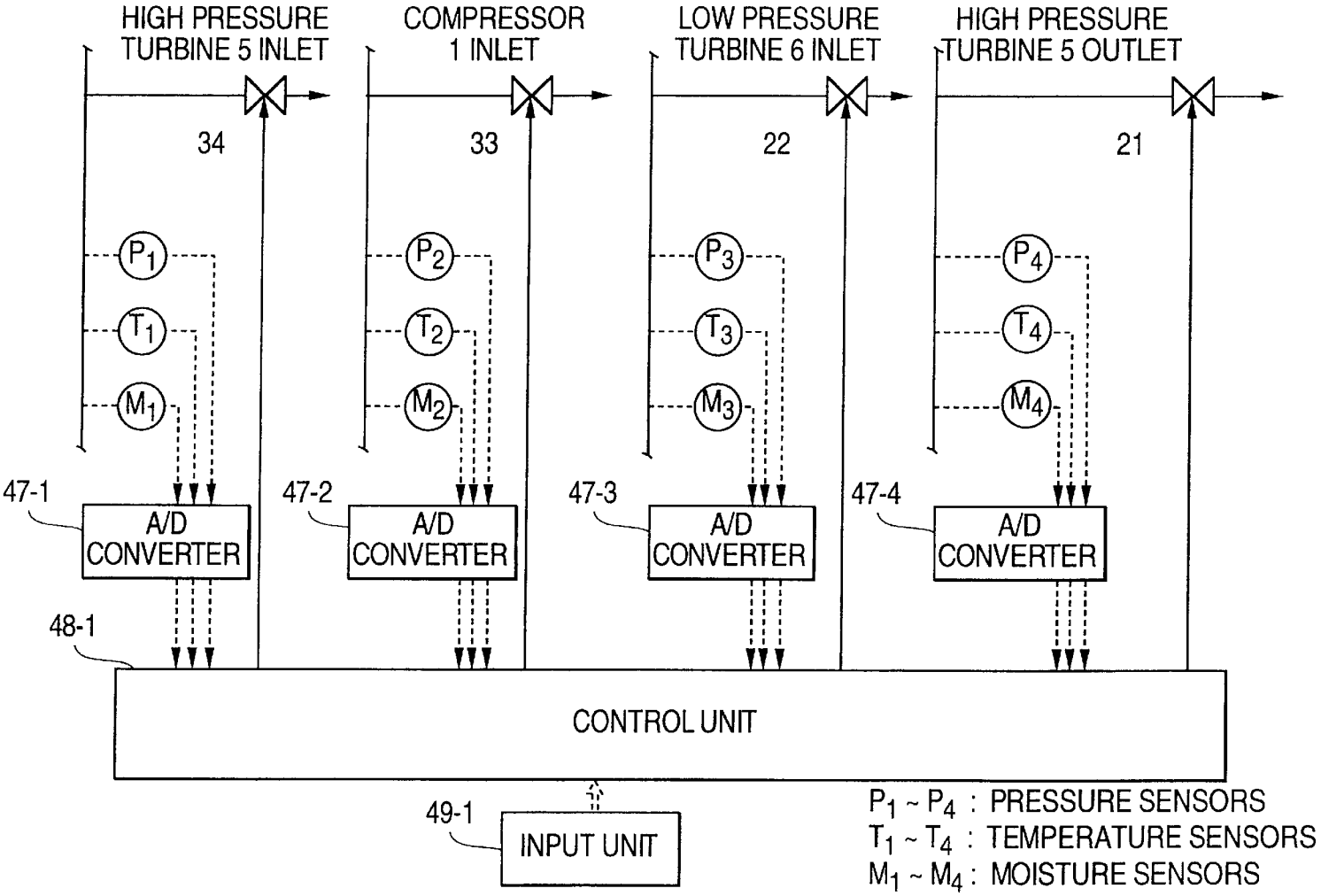
FIG. 2 is a diagrammatic view of a steam control system of the hydrogen burning turbine plant of FIG. 1.

FIG. 2 is a diagrammatic view of a steam control system of the hydrogen burning turbine plant described with respect to FIG. 1. In FIG. 2, the drain valve 34, a pressure sensor $P_1$, a temperature sensor $T_1$ and a moisture sensor $M_1$ of the steam are provided at the inlet of the high pressure turbine 5. Likewise, the drain valve 33, a pressure sensor $P_2$, a temperature sensor $T_2$ and a moisture sensor $M_2$ of the steam are provided at the inlet of the compressor 1. Also provided are the drain valve 22, a pressure sensor $P_3$, a temperature sensor $T_3$ and a moisture sensor $M_3$ of the steam at the inlet of the low pressure turbine 6. Further provided are the drain valve 21, a pressure sensor $P_4$, a temperature sensor $T_4$ and a moisture sensor $M_4$ of the steam at the outlet of the high pressure turbine 5.

The drain valves 34, 33, 22, 21, pressure sensors $P_1$ to $P_4$, temperature sensors $T_1$ to $T_4$ and moisture sensors $M_1$ to $M_4$ are connected to a control unit 48-1 via A/D converters 47-1 to 47-4, respectively. The control unit 48-1, receiving detected signals of the pressure sensors $P_1$ to $P_4$, the temperature sensors $T_1$ to $T_4$ and the moisture sensors $M_1$ to $M_4$ of respective systems via the A/D converters 47-1 to 47-4, sends signals to open the drain valves 34, 33, 22, 21 to thereby discharge the steam until such a steam condition of pressure, temperature and moisture relative to a normal operation of the respective systems is attained, and also sends signals to close the corresponding drain valves 34, 33, 22, 21 when the desired steam condition is met. The drain valves 34, 33, 22 and 21 are so controlled.

In the control unit 48-1, a dry steam condition (pressure, temperature, moisture) of normal operation is stored for respective systems at the high pressure turbine 5 inlet, the compressor 1 inlet, the low pressure turbine 6 inlet and the high pressure turbine 5 outlet. Setting of the condition is inputted from an input unit 49-1 so as to be set in a storage of the control unit 48-1, and valves so set may be corrected as the case may be.

The control unit 48-1, upon start of the plant, takes detected signals of the pressure sensors $P_1$ to $P_4$, the temperature sensors $T_1$ to $T_4$ and the moisture sensors $M_1$ to $M_4$ of respective systems, desides whether or not the stored dry steam condition (pressure, temperature, moisture) required for normal operation is satisfied for all the respective system. If the condition is not satisfied, the control unit 48-1 outputs a signal to open the corresponding drain valves 34, 33, 22, 21 and, if the condition is satisfied, the control unit 48-1 outputs a signal to close the corresponding drain valves 34, 33, 22, 21.

It is to be noted that, in the above, an example where the pressure sensors, temperature sensors, moisture sensors and drain valves are provided at four places, and the four drain valves are controlled by the control unit has been described; however, the present invention is not limited thereto but the drain valves to be controlled may be provided at necessary places or in appropriate combinations according to requirements, plant characteristics, etc.

In the present embodiment, as mentioned above, the auxiliary boiler 12 is operated at a starting time, the steam generated at the combustion chamber 2 is diluted, and then the plant operation is started. But, until the cycle becomes self-sustained and the steam condition (pressure, temperature, moisture) of the respective systems is established, if a wet steam, which does not satisfy the steam condition, enters the compressor or turbine, there is a risk of breakage thereof.

By performing the control as described above, however, at the starting time of the plant, the drain valve corresponding to the system which does not satisfy the steam condition is opened so that the steam is discharged therefrom and, if the steam condition is satisfied, the drain valve is closed, and a steady operation is realized. Thus, a safe and secure starting operation of the plant is carried out.

In the above, an example of using the pressure sensors $P_1$ to $P_4$, temperature sensors $T_1$ to $T_4$ and moisture sensors $M_1$ to $M_4$ has been described, but the moisture sensors may not necessarily be provided. If the pressure sensors and the temperature sensors are provided, the function of the present invention may be attained such that pressure and temperature of the steam are measured, and the desired steam condition is set with the drain valves 34, 33, 22, 21 being controlled by the control unit 48-1. By use of the moisture sensors $M_1$ to $M_4$, however, the present invention may be realized with a higher accuracy.

Figure 3:
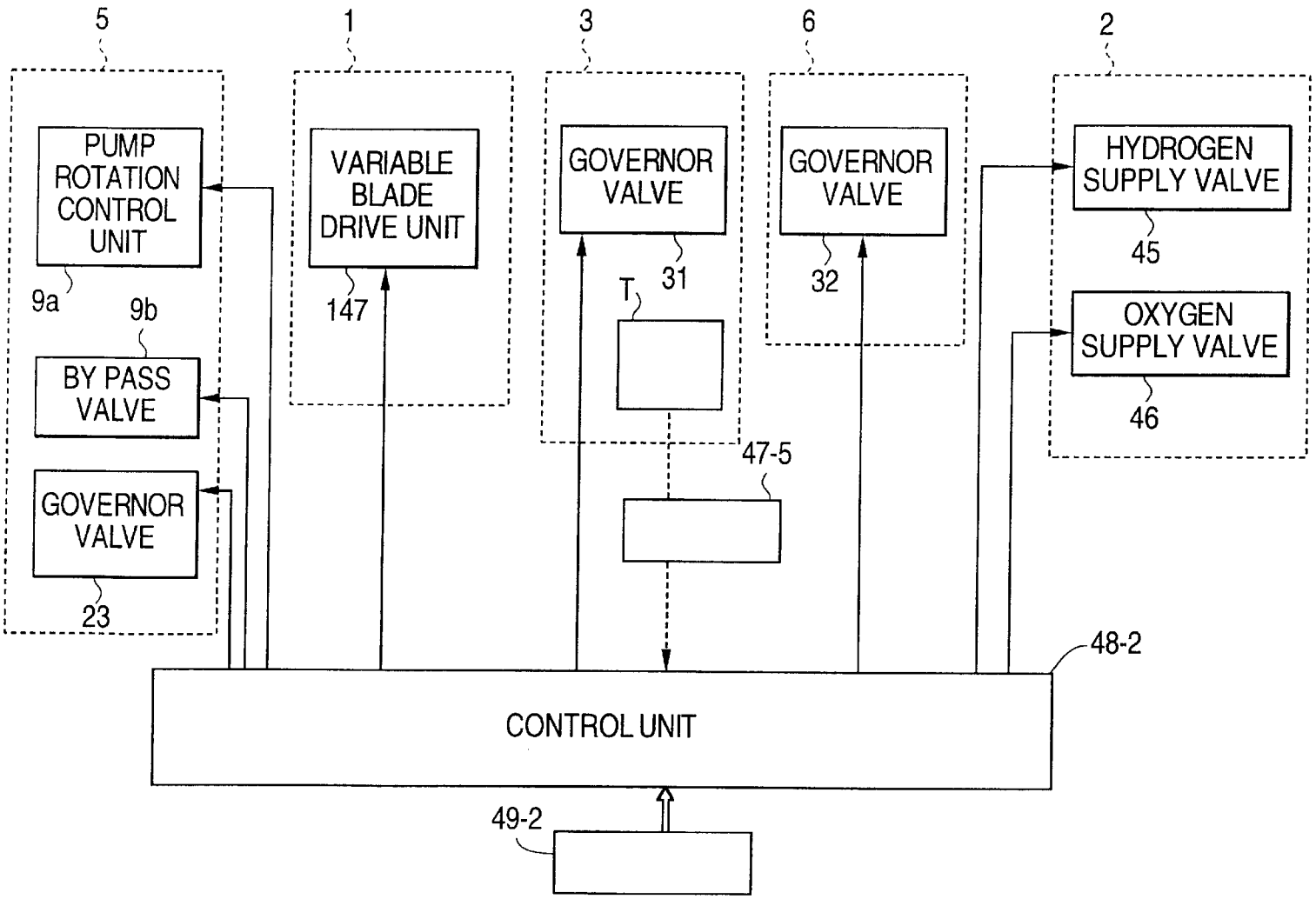
FIG. 3 is a diagrammatic view of control of flow control valves of the hydrogen burning turbine plant of FIG. 1.

FIG. 3 is a diagrammatic view of control of flow control valves of the hydrogen burning turbine plant of the embodiment of FIG. 1. In FIG. 3, there are provided a governor valve 23 on the inlet side of the high pressure turbine 5, a rotation control unit 9*a* of the feedwater pump 9 that is in the flow passage on the inlet side of the high pressure turbine 5, and a bypass valve 9*b* disposed in parallel with the feedwater pump 9. Control lines of these units are connected to a control unit 48-2.

Also, there are provided a variable blade drive unit 147 for the compressor 1, with some of the stationary blades thereof being variable blades, a governor valve 32 on the inlet side of the low pressure turbine 6, and a hydrogen supply valve 45 along with an oxygen supply valve 46 on the inlet side of the combustion chamber 2. Control lines of these valves are connected to the control unit 48-2. Also connected to the control unit 48-2 via an A/D converter 47-5 is a temperature sensor T for measuring steam temperature at the outlet of the high temperature high pressure turbine 3-1 of the turbine 3.

Further, there is provided a governor valve 31 in a passage of steam, extracted from return steam of the high pressure turbine 5 for cooling blades of the turbine 3, and a control line thereof is connected to the control unit 48-2.

In the control systems constructed as mentioned above, the control unit 48-2 controls the variable blade drive unit 147 so as to drive rotatively the variable blades, with the variable blades being some of the stationary blades of the compressor 1. Each variable blade is constructed to rotate around one point on a blade chord so as to make the flow rate through the compressor variable. The control is done such that characteristics of the rotational angle of the variable blades, and the steam pressure at the compressor 1 outlet in relation to the flow rate through the compressor 1, are stored in advance in the control unit 48-2. In accordance with the steam flow rate and pressure condition set in an input unit 49-2, the control unit 48-2 controls the variable blade drive unit 147 so as to correspondingly set the angle of the variable blades.

Also, the control unit 48-2 controls the governor valve 23 at the high pressure turbine 5 inlet so that outlet steam pressure of the high pressure turbine 5 is controlled. The control is performed such that characteristics of the opening of the governor valve 23, and the outlet steam pressure of the high pressure turbine 5 are stored in advance in the control unit 48-2. In accordance with the high pressure turbine operation condition set in the input unit 49-2, the control unit 48-2 controls the opening of the governor valve 23 so that the outlet steam pressure at the high pressure turbine 5 is correspondingly controlled. Also, the control unit 48-2 controls rotation of the feedwater pump 9 via the rotation control unit 9*a*, or controls opening of the bypass valve 9*b*, so that the steam flow rate of the high pressure turbine 5 is controlled in accordance with the condition set in advance.

Also, the control unit 48-2 controls the governor valve 32 at the low pressure turbine 6 inlet so that the inlet steam pressure and flow rate of the low pressure turbine 6 are controlled. The control unit 48-2 also controls the governor valve 31 of the blade cooling steam flowing into the high temperature high pressure turbine 3-1 and the high temperature low pressure turbine 3-2 of the turbine 3 so that the flow rate and pressure of the steam returning from the high temperature high pressure turbine 3-1 and the high temperature low pressure turbine 3-2 to the compressor 1 are controlled. These controls are performed, like those mentioned above, such that the opening of the respective governor valves is controlled in accordance with the condition set in advance in the control unit 48-2.

Further, the control unit 48-2 controls the hydrogen supply valve 45 and the oxygen supply valve 46, such that the amount of hydrogen and oxygen to be supplied into the combustion chamber 2 as fuel is controlled. In the control unit 48-2, characteristics of control temperature at the high temperature high pressure turbine 3-1 inlet in relation to fuel ratio, flow rate, opening of the valve, etc. are set and stored in advance. The control unit 48-2 is inputted a signal from the temperature sensor T provided at the outlet of the turbine 3 or midway therein and, while watching this detected signal, the control unit 48-2 controls the opening of the hydrogen supply valve 45 and the oxygen supply valve 46 in accordance with the set condition so as not to exceed the set temperature.

It is to be noted that, in the above, an example where the control is performed such that the entire system of the high pressure turbine 5 inlet, the variable blades of the compressor 1, the low pressure turbine 6 inlet, the turbine 3 cooling steam inlet and the combustion chamber 2 are controlled by the control unit 48-2 has been described; however, the present invention is not necessarily limited thereto, and the control unit may be selected so that each of the systems is controlled individually or in certain combinations according to requirements, plant characteristics, etc.

Figure 4:
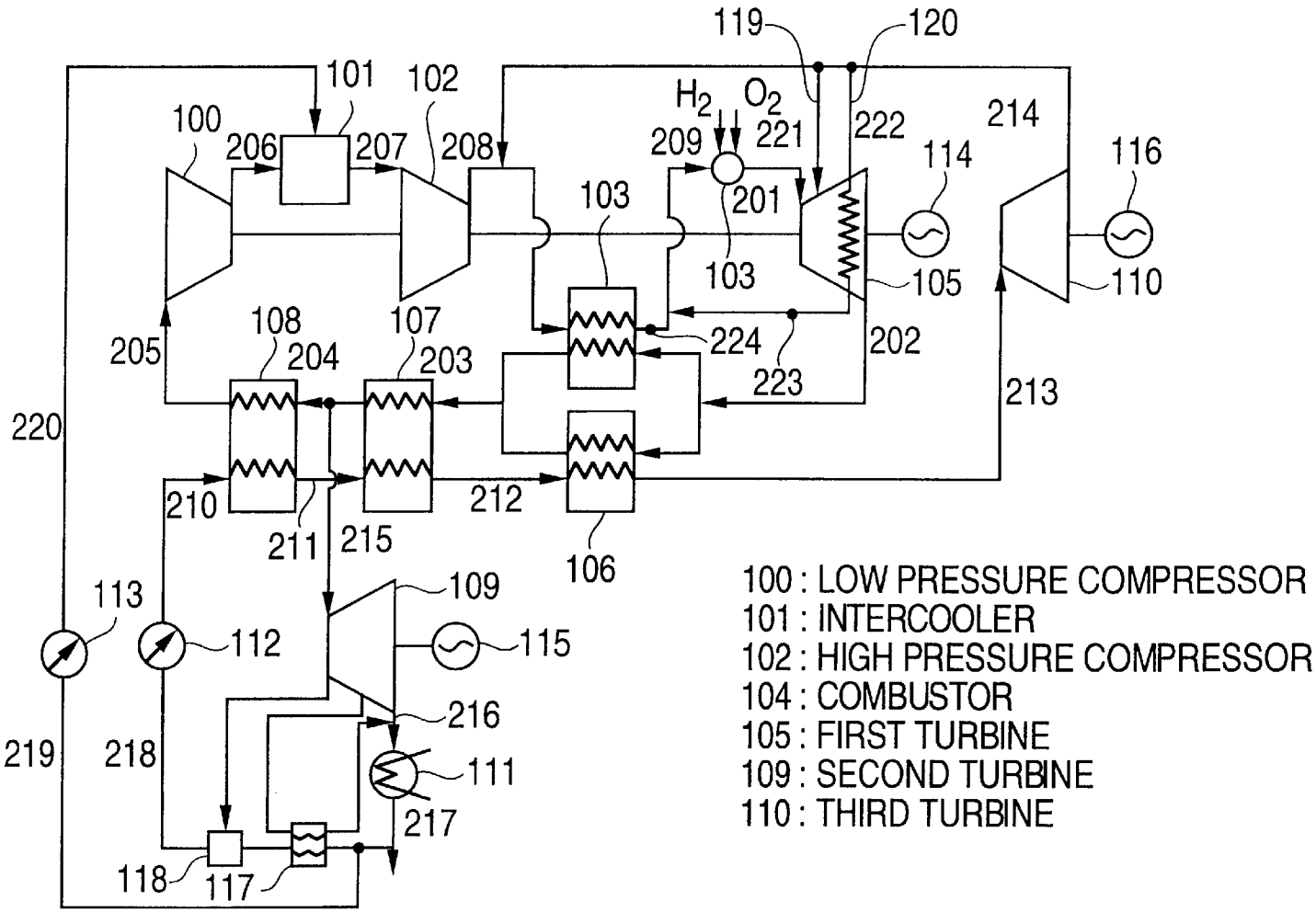
FIG. 4 is a diagrammatic view of a hydrogen burning turbine plant of another embodiment according to the present invention.
Figure 5:
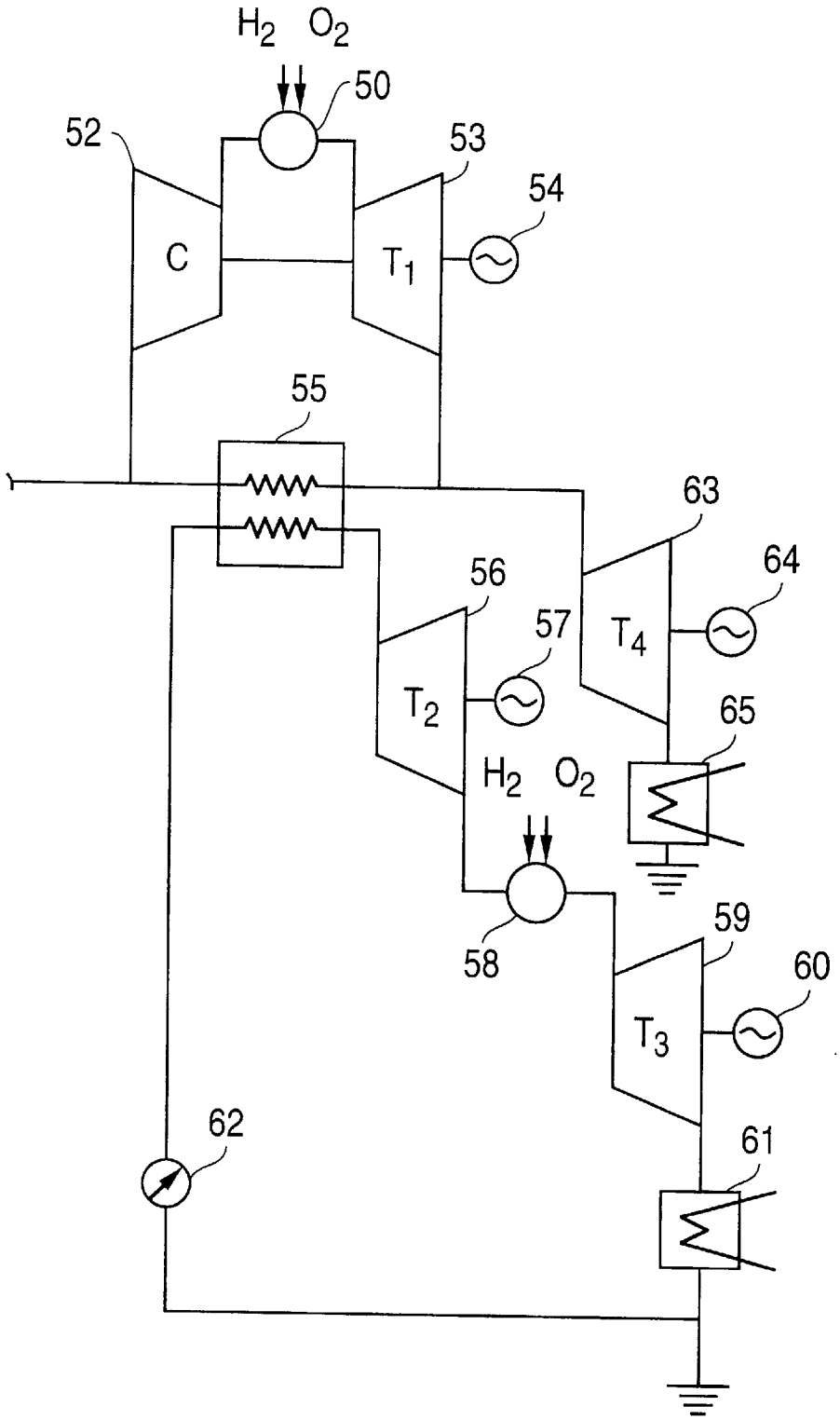
FIG. 5 (PRIOR ART)
FIG. 5 is a diagrammatic view of one example of a prior art hydrogen burning turbine plant.
Figure 6:
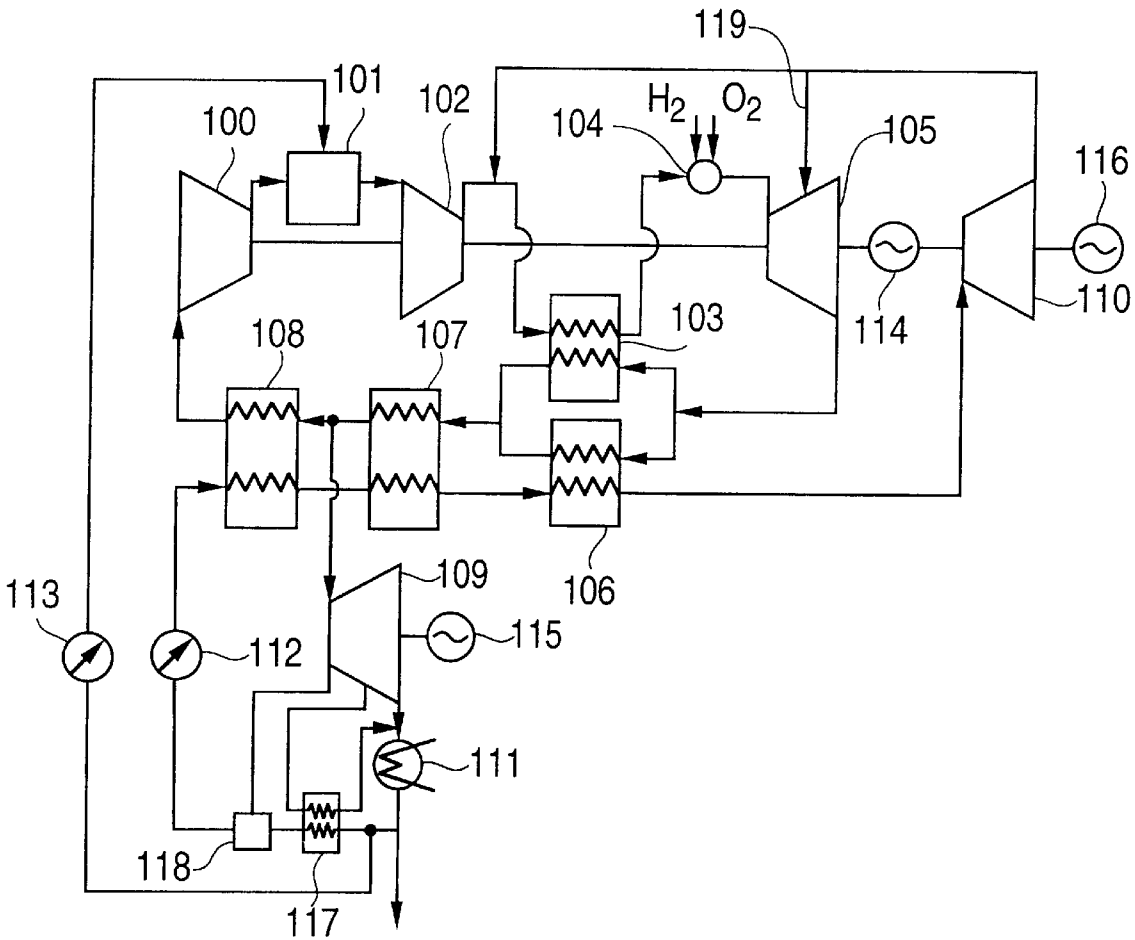
FIG. 6 (PRIOR ART)
FIG. 6 is a diagrammatic view of another example of a prior art hydrogen burning turbine plant.

FIG. 4 is a diagrammatic view of a hydrogen burning turbine plant of another embodiment according to the present invention. In FIG. 4, same reference numerals as those in FIG. 6 of the prior art plant designate same or similar parts. The present embodiment is featured in that a recovery type cooling steam system is added to the cooling system of the first turbine 105 such that, in addition to the first turbine cooling steam 119 of the prior art, a first turbine recovery type cooling steam 120 is extracted from an outlet of the third turbine 110, which steam is to be introduce into the first turbine 105 for cooling thereof. The steam used for this cooling is mixed with an outlet steam of the heat exchanger 103 (inlet steam of the combustor 104).

Figure 7:
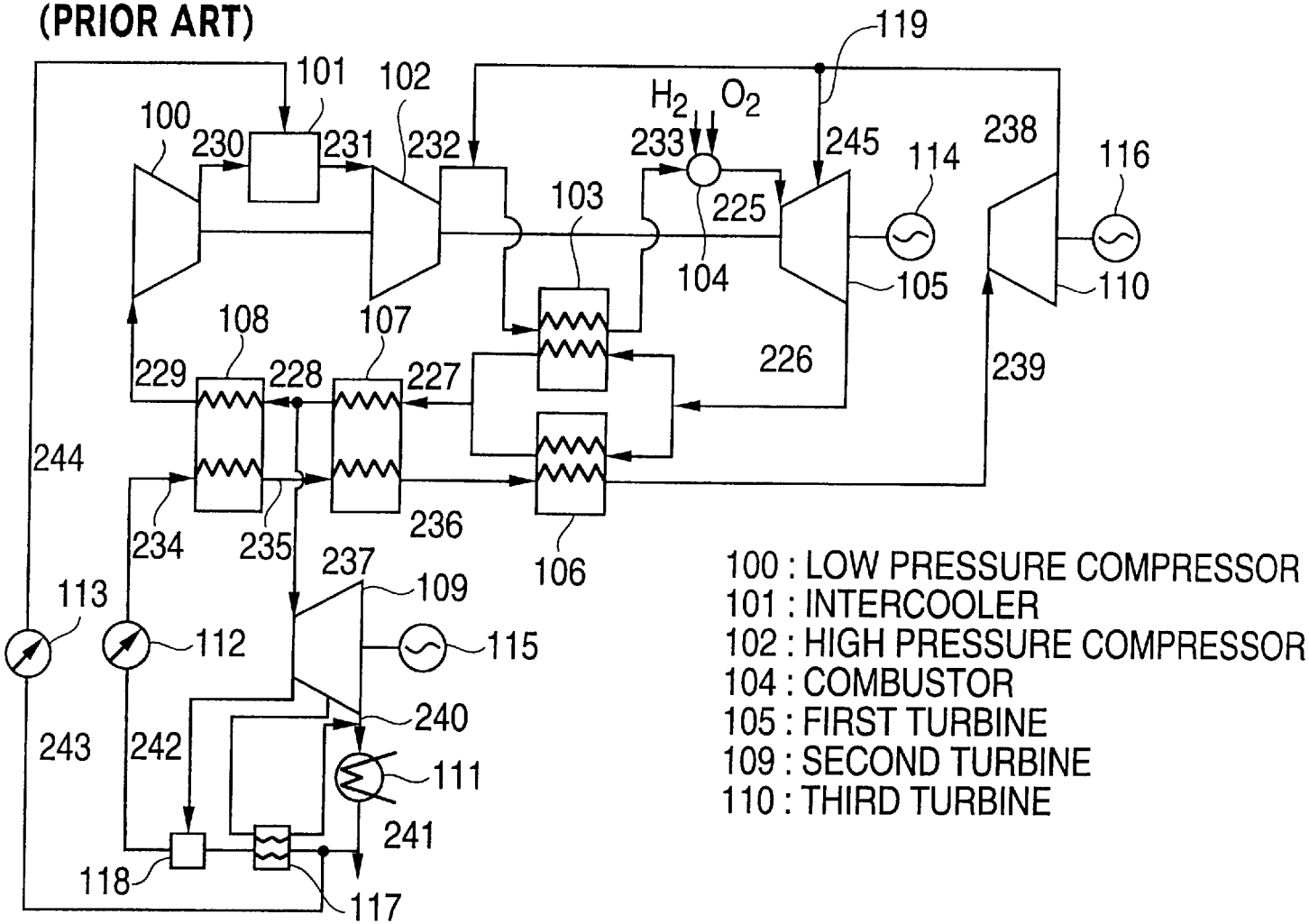
FIG. 7 (PRIOR ART)
FIG. 7 is a diagrammatic view which is the same as FIG. 4, but is provided with reference numerals 225 to 245 which designate measuring positions in comparison with FIG. 4, in which FIG. 4 reference numerals 201 to 224 designate measuring positions.

Examples of cycle calculations in the hydrogen burning turbine plant are shown in Table 1 with respect to the present invention, and in Table 2 with respect to the prior art. In Tables 1 and 2, flow rate, temperature and pressure at respective positions shown by reference numerals 201 to 245 in FIG. 4 and FIG. 7, are shown wherein the plant is depicted in FIG. 7 is same as that depicted in FIG. 6, FIG. 4 includes reference numerals 201 to 224, and FIG. 7 includes reference numerals 225 to 245.

As understood from Tables 1 and 2, in the present invention the total value of the cooling medium proportion of the first turbine increases from 0.15 to 0.172 when compared with the prior art. 0.109 out of the 0.172 is replaced by the recovery type cooling steam, and the value of the cooling steam mixing into the gas path of the first turbine reduces from 0.15 (prior art) to 0.063 (present invention). Accordingly, there is obtained an effect in which the gross thermal efficiency increases from 60.3% to 61.0% with relative enhancement of 1.2%, when using presumptions of calculation shown in Table 3.

That is, if the usual cooling system using the first turbine cooling steam 119, and the recovery type cooling system using the first turbine recovery type cooling steam 120, are compared with each other, there is an advantage associated with the recovery type cooling system in that temperature lowering of the fluid in the gas path, due to mixing of the cooling medium with the turbine gas path, and pressure loss due to mixing of the cooling medium and the fluid in the gas path are eliminated. Thus, the turbine output being reduced due to the cooling is mitigated. Also, the heat obtained from the turbine by the recovery type cooling system is recovered upstream of the combustor, whereby the fuel flow rate can be reduced, which is also one reason for enhancing the gross thermal efficiency.

TABLE 1

| Reference numeral Nos. | Flow rate (kg/s) | Temperature (° C.) | Pressure ($10^5$ Pa) |
|---|---|---|---|
| 201 | 237 | 1700 | 45.1 |
| 202 | 252 | 756 | 1.2 |
| 203 | 252 | 528 | 1.1 |
| 204 | 116 | 235 | 1.1 |
| 205 | 116 | 105 | 1.0 |
| 206 | 116 | 234 | 3.1 |
| 207 | 125 | 139 | 3.1 |
| 208 | 125 | 550 | 50.0 |
| 209 | 186 | 700 | 47.5 |
| 210 | 75 | 82 | 408 |
| 211 | 75 | 177 | 388 |
| 212 | 75 | 473 | 368 |
| 213 | 75 | 593 | 350 |
| 214 | 75 | 291 | 50 |

TABLE 1-continued

| | | | |
|---|---|---|---|
| 215 | 136 | 235 | 1.1 |
| 216 | 130 | 33 | 0.05 |
| 217 | 130 | 33 | 1.2 |
| 218 | 75 | 77 | 1.0 |
| 219 | 9 | 33 | 1.2 |
| 220 | 9 | 33 | 3.1 |
| 221 | 15 | 269 | 34.1 |
| 222 | 26 | 291 | 50.0 |
| 223 | 26 | 291 | 50.0 |
| 224 | 160 | 716 | 47.5 |

First turbine
inlet temperature: 1700° C.
Cooling medium proportion = First turbine cooling steam (0.063) + First turbine recovery type cooling steam (0.109) = 0.172

| Items | Output (MW) |
|---|---|
| Low pressure compressor | 28.9 |
| High pressure compressor | 101.6 |
| First turbine | 543.6 |
| Second turbine | 63.7 |
| Third turbine | 36.0 |
| Machine loss | 5.1 |
| Generator loss | 7.6 |
| Total output | 500 |

Gross thermal efficiency 61.0% (HHV reference)

TABLE 2

| Reference numeral Nos. | Flow rate (kg/s) | Temperature (° C.) | Pressure ($10^5$ Pa) |
|---|---|---|---|
| 225 | 237 | 1700 | 45.1 |
| 226 | 272 | 717 | 1.2 |
| 227 | 272 | 526 | 1.1 |
| 228 | 134 | 300 | 1.1 |
| 229 | 138 | 105 | 1.0 |
| 230 | 138 | 234 | 3.1 |
| 231 | 149 | 140 | 3.1 |
| 232 | 149 | 550 | 50.0 |
| 233 | 185 | 682 | 47.5 |
| 234 | 71 | 70 | 408 |
| 235 | 71 | 248 | 388 |
| 236 | 71 | 486 | 368 |
| 239 | 71 | 593 | 350 |
| 238 | 71 | 291 | 50 |
| 237 | 134 | 300 | 1.1 |
| 240 | 130 | 33 | 0.05 |
| 241 | 130 | 35 | 0.3 |
| 242 | 72 | 70 | 0.3 |
| 243 | 11 | 35 | 1.0 |
| 244 | 11 | 35 | 3.1 |
| 245 | 36 | 269 | 34.1 |

First turbine
inlet temperature: 1700° C.
Cooling medium proportion = 0.15

| Items | Output (MW) |
|---|---|
| Low pressure compressor | 34.5 |
| High pressure compressor | 121.1 |
| First turbine | 563.8 |
| Second turbine | 70.5 |
| Third turbine | 34.0 |

TABLE 2-continued

| | |
|---|---|
| Machine loss | 5.1 |
| Generator loss | 7.6 |
| Total output | 500 |
| Gross thermal efficiency 60.3% (HHV reference) | |

TABLE 3

| | |
|---|---|
| Compressor adiabatic efficiency | 0.89 |
| Turbine adiabatic efficiency | 0.93 |
| Combustor combustion efficiency | 1.0 |
| Combustor pressure loss | 5% of inlet pressure |
| Pump work | disregarded |
| Machine efficiency | 0.99 |
| Generator efficiency | 0.985 |
| First turbine inlet temperature (° C.) | 1700 |
| Cooling medium proportion | 0.15 of the first turbine inlet flow rate |
| Third turbine inlet pressure ($10^5$ Pa) | 350 |
| Third turbine inlet temperature (° C.) | 593 |

It is understood that the invention is not limited to the particular construction and arrangement herein illustrated and described, but embraces such modified forms thereof as come within the scope of the following claims.

What is claimed is:

1. A hydrogen burning turbine plant for burning hydrogen and oxygen to generate high temperature steam for driving a turbine, comprising:

a combustion chamber in which hydrogen and oxygen are to be burned for generating high temperature steam;

a turbine to receive and be driven by the high temperature steam;

a heat exchanger to receive exhaust steam from said turbine and to remove heat from the exhaust steam;

a low pressure compressor to receive exhaust steam from said heat exchanger and to compress this exhaust steam;

a high pressure compressor to receive the compressed exhaust steam from said low pressure compressor, to further compress this exhaust steam, and to supply the further compressed exhaust steam to said combustion chamber;

a spray device to spray water onto the compressed exhaust steam discharged from said low pressure compressor before this exhaust steam enters said high pressure compressor; and a boiler to create steam and supply this steam to the steam to be supplied to said combustion chamber, such that the temperature of the high temperature steam generated by the burning of the oxygen and hydrogen in said combustion chamber at a starting time of the plant is less than it would be absent the steam created by the boiler being supplied to the steam supplied to the combustion chamber.

2. The hydrogen burning turbine plant according to claim 1, wherein said boiler is to create a high pressure steam and supply the high pressure steam to the steam to be supplied to said combustion chamber by supplying the high pressure steam to an inlet of said low pressure compressor.

3. The hydrogen burning turbine plant according to claim 1, wherein said boiler is to create a high pressure steam and supply the high pressure steam to the steam to be supplied to said combustion chamber by supplying the high pressure steam to the compressed exhaust steam discharged from said low pressure compressor prior to the compressed exhaust steam being supplied to said high pressure compressor.

4. The hydrogen burning turbine plant according to claim 3, and further comprising a condenser to supply water to said spray device.

5. The hydrogen burning plant according to claim 2, and further comprising a condenser to supply water to said spray device.

6. The hydrogen burning turbine plant according to claim 1, and further comprising a condenser to supply water to said spray device.

7. A hydrogen burning turbine plant for burning hydrogen and oxygen to generate high temperature steam for driving a turbine, comprising:

a combustion chamber in which hydrogen and oxygen are to be burned for generating high temperature steam;

a first turbine to receive and be driven by the high temperature steam;

a heat exchanger to receive exhaust steam from said first turbine and to remove heat from the exhaust steam;

a compressor to receive exhaust steam from said heat exchanger, to compress this exhaust steam, and to supply the compressed exhaust steam to said combustion chamber;

a high pressure turbine to receive heat removed from the exhaust steam by said heat exchanger;

a low pressure turbine to receive and be driven by exhaust steam from said heat exchanger;

a condenser to receive exhaust steam from said low pressure turbine;

a steam pressure sensor;

a steam temperature sensor;

a drain valve; and a control unit to receive signals from said steam pressure sensor and said steam temperature sensor, and to operate said drain valve in response to these signals at a starting time of the plant, such that steam is discharged from said drain valve until a steam condition of a predetermined pressure and predetermined temperature is realized.

8. The hydrogen burning turbine plant according to claim 7, wherein said steam pressure sensor, said steam temperature sensor and said drain valve are positioned on an inlet side of said high pressure turbine.

9. The hydrogen burning turbine plant according to claim 7, wherein said steam pressure sensor, said steam temperature sensor and said drain valve are positioned on an inlet side of said compressor.

10. The hydrogen burning turbine plant according to claim 7, wherein said steam pressure sensor, said steam temperature sensor and said drain valve are positioned on an inlet side of said low pressure turbine.

11. The hydrogen burning turbine plant according to claim 7, and further comprising a system to supply exhaust steam from said high pressure turbine to said first turbine in order to cool blades of said first turbine, wherein said system comprises said steam pressure sensor, said steam temperature sensor and said drain valve.

12. The hydrogen burning turbine plant according to claim 7, wherein said steam pressure sensor, said steam temperature sensor and said drain valve are positioned on an inlet side of said low pressure turbine, and further comprising:

a second steam pressure sensor, a second steam temperature sensor and a second drain valve positioned on an inlet side of said high pressure turbine;

a third steam pressure sensor, a third steam temperature sensor and a third drain valve positioned on an inlet side of said compressor; and a fourth steam pressure senor, a fourth steam temperature sensor and a fourth drain valve postioned on an outlet side of said high pressure turbine;

wherein said control unit is to receive signals from each of said steam pressure sensors and from each of steam temperature sensors, and to operate each of said drain vales in response to these signals at a starting time of the plant.

13. A hydrogen burning turbine plant for burning hydrogen and oxygen to generate high temperature steam for driving a turbine, comprising;

a combustion chamber in which hydrogen and oxygen are to be burned for generating high temperature steam;

a first turbine to receive and be driven by the high temperature steam;

a heat exchanger to receive exhaust steam from said first turbine and to remove heat from the exhaust steam;

a compressor to receive exhaust steam from said heat exchanger, to compress this exhaust steam, and to supply the compressed exhaust steam to said combustion chamber;

a high pressure turbine to receive heat removed from the exhaust steam by said heat exchanger;

a low pressure turbine to receive and be driven by exhaust steam from said heat exchanger;

a condenser to receive exhaust steam from said low pressure turbine; and a control unit to control a steam flow rate based on predetermined characteristics of steam pressure and steam flow rate of each of said high pressure turbine, said first turbine, said low pressure turbine and said compressor, and also to control a fuel flow rate based on predetermined characteristics of steam temperature at an inlet end of said first turbine in relation to a fuel ratio, a fuel flow rate and an opening of a fuel valve.

14. The hydrogen burning turbine plant according to claim 13, wherein said compressor includes angularly variable blades, and said control unit is to control the steam flow rate and a pressure at said compressor by controlling the angular orientation of said angularly variable stationary blades.

15. The hydrogen burning turbine plant according to claim 13, and further comprising a valve and a pump positioned on an inlet side of said high pressure turbine, wherein said control unit is to control an output of said high pressure turbine by controlling said valve and said pump.

16. The hydrogen burning turbine plant according to claim 13, and further comprising a valve positioned on an inlet side of said low pressure turbine, wherein said control unit is to control said valve.

17. The hydrogen burning turbine plant according to claim 13, and further comprising a system to supply exhaust steam from said high pressure turbine to said first turbine in order to cool blade of said first turbine, with said system comprising a valve, wherein said control unit is to control said valve.

18. The hydrogen burning turbine plant according to claim 13, and further comprising an oxygen supply valve and a hydrogen supply valve for allowing the supply of oxygen and hydrogen into said combustion chamber, respectively, wherein said control unit is to detect a steam temperature of said first turbine and control said oxygen supply valve and said hydrogen supply valve in response to the detected steam temperature such that a predetermined temperature at an inlet of said first turbine is not exceeded.

19. The hydrogen burning turbine plant according to claim 13, and further comprising a valve at an inlet side of said high pressure turbine, a valve at an inlet side of said low pressure turbine, an oxygen supply valve and a hydrogen supply valve at an inlet side of said combustion chamber, and a cooling system to cool blades of said turbine, with a valve positioned at an inlet side of said cooling system, wherein said compressor includes variable blades, and said control unit is to monitor and control each of said valves and at least some of said variable blades.

* * * * *